US012569898B2

(12) United States Patent
Tachibana

(10) Patent No.: US 12,569,898 B2
(45) Date of Patent: Mar. 10, 2026

(54) TAIL END BUCKLING SUPPRESSION DEVICE

(71) Applicant: TOSHIBA MITSUBISHI-ELECTRIC INDUSTRIAL SYSTEMS CORPORATION, Tokyo (JP)

(72) Inventor: Minoru Tachibana, Tokyo (JP)

(73) Assignee: TMEIC CORPORATION, Tokyo (JP)

( * ) Notice: Subject to any disclaimer, the term of this patent is extended or adjusted under 35 U.S.C. 154(b) by 222 days.

(21) Appl. No.: 18/261,487

(22) PCT Filed: Dec. 24, 2021

(86) PCT No.: PCT/JP2021/048283
§ 371 (c)(1),
(2) Date: Jul. 14, 2023

(87) PCT Pub. No.: WO2023/119640
PCT Pub. Date: Jun. 29, 2023

(65) Prior Publication Data
US 2024/0075510 A1 Mar. 7, 2024

(51) Int. Cl.
*B21B 37/66* (2006.01)
*B21B 31/02* (2006.01)

(52) U.S. Cl.
CPC ..... *B21B 37/66* (2013.01); *B21B 31/02* (2013.01)

(58) Field of Classification Search
CPC ..... B21B 31/02; B21B 33/02; B21B 37/38; B21B 37/66; B21B 37/68; B21B 37/72
See application file for complete search history.

(56) References Cited

U.S. PATENT DOCUMENTS 6,839,605 B2 * 1/2005 Park ..... G05B 23/0235 702/185
8,185,232 B2 * 5/2012 Higo ..... B21B 37/00 72/11.8
2010/0192654 A1 * 8/2010 Tachibana ..... B21B 37/16 72/12.7

FOREIGN PATENT DOCUMENTS

| | | | |
|---|---|---|---|
| JP | S50-035901 | B2 | 11/1975 |
| JP | S58-145303 | A | 8/1983 |
| JP | H04251602 | A | 9/1992 |
| JP | 2002-096109 | A | 4/2002 |
| JP | 2013-180322 | A | 9/2013 |
| WO | 2012/086043 | A1 | 6/2012 |

OTHER PUBLICATIONS

JP 04-251602A, Kawase Sep. 1992.*
(Continued)

*Primary Examiner* — Edward T Tolan
(74) *Attorney, Agent, or Firm* — XSENSUS LLP

(57) ABSTRACT

The present disclosure relates to a tail end buckling suppression device for a tandem rolling mill rolling a material to be rolled by N (N≥2) successive rolling stands. Each i-th rolling stand (1≤i≤N) of the tandem rolling mill includes an i-th roll bender device screwing down the material to be rolled with preset roll bender pressure. During a period after a tail end of the material to be rolled comes out of one designated j-th rolling stand (1≤j≤N−1) until the tail end of the material to be rolled comes out of the N-th rolling stand, the tail end buckling suppression device causes each of j+1-th to N-th roll bender devices downstream of the j-th rolling stand to continuously lower the roll bender pressure.

9 Claims, 6 Drawing Sheets

(56) References Cited

OTHER PUBLICATIONS

Translation JP 04-251602A, Kawase Sep. 1992.*
Translation JP 58-145303A, Okabe Aug. 1983.*
Office Action issued on May 14, 2024, in corresponding Japanese patent Application No. 2023-519371, 6 pages.
Office Action issued Jul. 14, 2023 in corresponding Taiwan Patent Application No. 111135978 with machine English translation thereof, 10 pages.
International Search Report issued Mar. 8, 2022 in PCT/JP2021/048283 and English translation thereof, 5 pages.
English translation of the International Preliminary Report On Patentability (Chapter I) mailed on Jul. 4, 2024, in corresponding PCT/JP2021/048283, 6 pages.
Office Action dated Jul. 2, 2025 in the corresponding Chinese patent application No. 202180087528.5, 14 pp.
Preliminary Office Action dated Jul. 9, 2025 in the corresponding Brazilian patent application No. 112023012799-8, 5 pp.
Office Action dated Jul. 25, 2025 in the corresponding Korean patent application No. 10-2023-7022430, 9 pp.

* cited by examiner

| STEEL GRADE | FINAL STAND DELIVERY-SIDE TARGET THICKNESS | DESIGNATED STAND |
|---|---|---|
| A | 2.0mm | THIRD ROLLING STAND |
| B | 2.0mm | FOURTH ROLLING STAND |
| C | 1.5mm | THIRD ROLLING STAND |
| ... | ... | ... |

FIG. 4

TAIL END BUCKLING SUPPRESSION DEVICE

CROSS-REFERENCE TO RELATED APPLICATION

The present application is based on PCT filing PCT/JP2021/048283, filed Dec. 24, 2021, the entire contents of which are incorporated herein by reference.

FIELD

The present disclosure relates to a tail end buckling suppression device for a tandem rolling mill including a plurality of rolling stands.

BACKGROUND

As a trouble occurring in a case where a hot finishing mill rolls a material to be rolled, buckling accident of the material to be rolled is known. The buckling accident of the material to be rolled is a trouble in which tensile force is released when an extreme tail end of the material to be rolled passes through a rolling stand to cause a meandering state, and the material to be rolled is folded by coming into contact with a side guide of the rolling stand. When the buckling accident occurs, scratch occurs on the tail end of the material to be rolled to cause quality failure. Further, as a result of rolling of the buckled portion, scratch occurs on a surface of a work roll. The scratch is transferred to a subsequent material to be rolled to cause quality failure.

As a technique to prevent meandering that causes the buckling accident, the following patent literatures are known.

PTL 1 discloses that, in order to prevent meandering, an image of the tail end of the material to be rolled is displayed on a monitor, and an operator monitors the tail end of the material to be rolled. PTL 2 discloses that, in order to prevent meandering, control to keep a calculated roll interval is performed when the tail end comes out of the rolling stand, in consideration of the fact that right-left asymmetric property (wedge) of a plate thickness and influence of the asymmetric property on meandering (parallelism stiffness), relating to a meandering amount of a plate, are reduced as roll force is reduced. PTL 3 discloses that, in order to prevent meandering, a meandering amount is calculated based on a torque difference detected from a plurality of split rolls provided between stands and screw-down leveling is adjusted.

CITATION LIST

Patent Literature

[PTL 1] JP 2013-180322 A
[PTL 2] JP 2002-096109 A
[PTL 3] WO 2012/086043 A

SUMMARY

Technical Problem

The method of preventing meandering is disclosed as described above. However, the control method based on complicated calculation is not necessarily appropriate. It is desirable to prevent the buckling accident caused by meandering of the material to be rolled by simple control. As a result of thorough research, the inventor of the present application has discovered a method of preventing the buckling accident caused by meandering of the material to be rolled by simple control using a roll bender device.

The present disclosure is made to solve the above-described problems, and an object of the present disclosure is to provide a tail end buckling suppression device that controls a material to be rolled to pass through center of a rolling line by using roll bender devices, thereby preventing meandering of the material to be rolled and tail end buckling.

Solution to Problem

A first aspect relates to a tail end buckling suppression device for a tandem rolling mill rolling a material to be rolled by N ($N \geq 2$) rolling stands arranged in series.

Each i-th rolling stand ($1 \leq i \leq N$) of the tandem rolling mill includes an i-th roll bender device configured to screw down the material to be rolled with preset roll bender pressure.

During a period after a tail end of the material to be rolled comes out of one designated j-th rolling stand ($1 \leq j \leq N-1$) until the tail end of the material to be rolled comes out of the N-th rolling stand, the tail end buckling suppression device causes each of j+1-th to N-th roll bender devices downstream of the j-th rolling stand to continuously lower the roll bender pressure.

A second aspect further includes following characteristics in addition to the characteristics in the first aspect.

The tail end buckling suppression device stores designated stand information defining a plurality of relationships between a combination of a steel grade with an N-th rolling stand delivery side target thickness, and a designated stand relating to tail end buckling suppression.

The j-th rolling stand is the designated stand selected from the designated stand information when the combination of the steel grade with the N-th rolling stand delivery side target thickness is input.

A third aspect further includes the following characteristics in addition to the characteristics in the first and second aspects.

Each of the j+1-th to N-th roll bender devices holds, when the own roll bender pressure reaches balance pressure, the own roll bender pressure at the balance pressure.

Effects of Invention

According to the present disclosure, when the material to be rolled comes out of the designated stand, the tail end buckling suppression device generates a crown on the material to be rolled by lowering the roll bender pressure of the subsequent stands. As a result, the material to be rolled is controlled to pass through center of a rolling line, and meandering of the material to be rolled and tail end buckling are suppressed.

BRIEF DESCRIPTION OF DRAWINGS

FIG. 4 is a table illustrating an example of designated stand information according to the embodiment;

DESCRIPTION OF EMBODIMENTS

Figure 1:
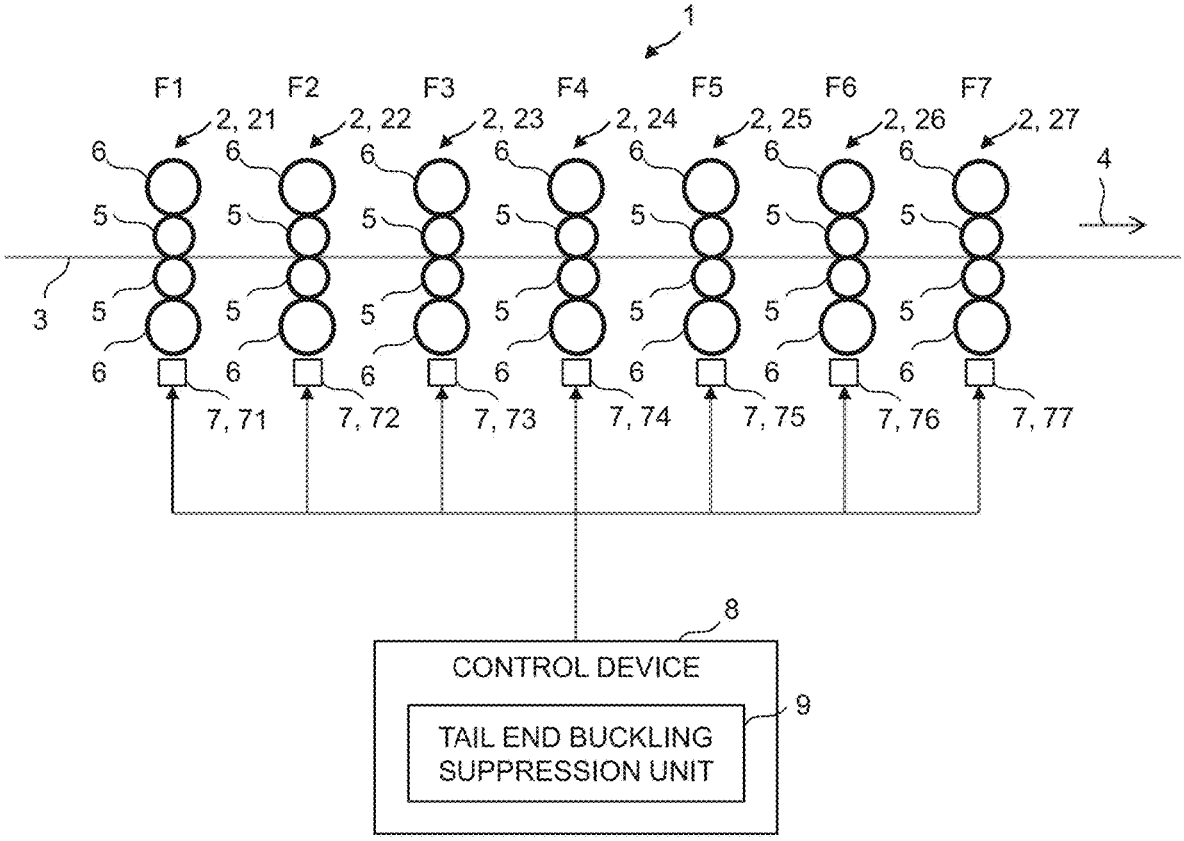
FIG. 1 is a diagram to explain a configuration example of a finishing mill according to an embodiment.

An embodiment of the present invention is described in detail below with reference to drawings. Note that elements common to the drawings are denoted by the same reference numerals, and repetitive descriptions are omitted.

Embodiment

1. System Configuration

FIG. 1 is a diagram to explain a configuration example of a finishing mill 1 in a hot rolling line.

A heating furnace, a roughing mill, a scale breaker, and the like all not illustrated are provided upstream of the finishing mill 1. A run out table (ROT), a coiler, and the like all not illustrated are provided downstream of the finishing mill 1.

The finishing mill 1 is a tandem rolling mill including N (N≥2) rolling stands 2 arranged in series. The finishing mill 1 illustrated in FIG. 1 includes seven (N=7) rolling stands 2 (first rolling stand 21, second rolling stand 22, third rolling stand 23, fourth rolling stand 24, fifth rolling stand 25, sixth rolling stand 26, and seventh rolling stand 27). The finishing mill 1 continuously rolls a belt-like steel material (material to be rolled 3) in one direction (arrow 4) from the upstream to the downstream. Final quality relating to sizes such as a thickness and a width of the material to be rolled 3 is determined by finish rolling.

Note that the number of rolling stands 2 is not limited thereto. In a case where the rolling stands are not particularly distinguished from one another, the rolling stands are simply referred to as the "rolling stands 2".

Each of the rolling stands 2 includes work rolls (WRs) 5 and back up rolls (BURs) 6. The work rolls 5 are rolling rolls rolling the material to be rolled 3 by rotating while being in contact with the material to be rolled 3. Each work roll 5 is connected to an electric motor driving a rotary shaft of the work roll 5, and a drive device of the electric motor. The back up rolls 6 support the work rolls 5, and straighten the work rolls 5 in a rotation axis direction. The back up rolls 6 are rotated following rotation of the work rolls 5 by friction with the work rolls 5.

Note that the finishing mill 1 may further include intermediate rolls between the work rolls 5 and the back up rolls 6.

Each of the rolling stands 2 includes various kinds of actuators, for example, a roll bender device 7 to control roll bender pressure, the drive devices (not illustrated) controlling speeds of the work rolls 5, and a screw down device (not illustrated) to control a roll gap. A control device 8 controls the various kinds of actuators based on an operation amount calculated so as to satisfy a final stand delivery side target thickness, a final stand delivery side target temperature, and the like. Further, the control device 8 controls the various kinds of actuators by feeding back a difference between a measurement value of a sensor (thickness meter, speed meter, pyrometer, etc.) not illustrated and a target value.

Figure 2:
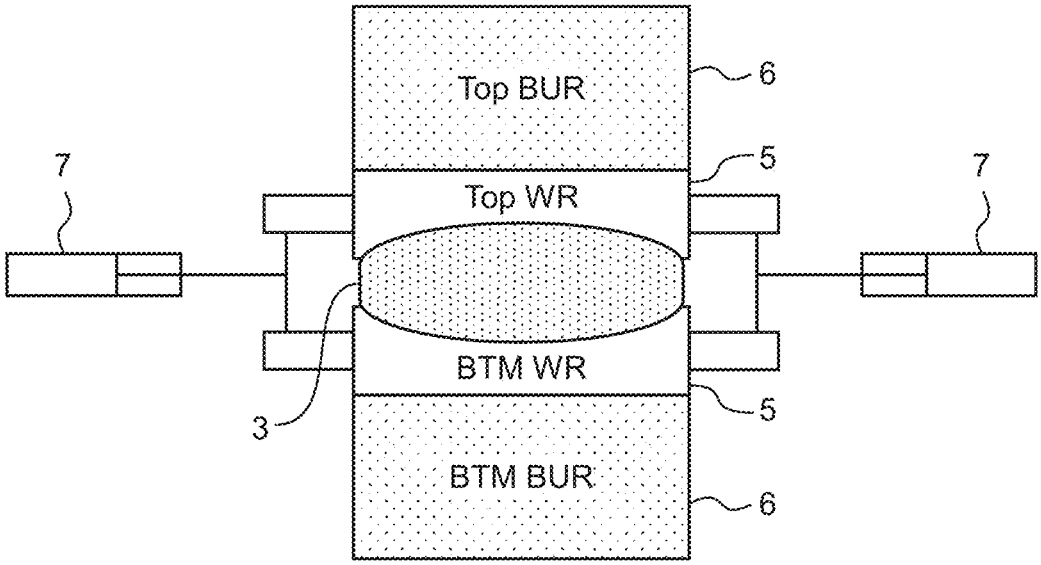
FIG. 2 is a diagram to explain a roll bender device of a rolling stand according to the embodiment.
Figure 3:
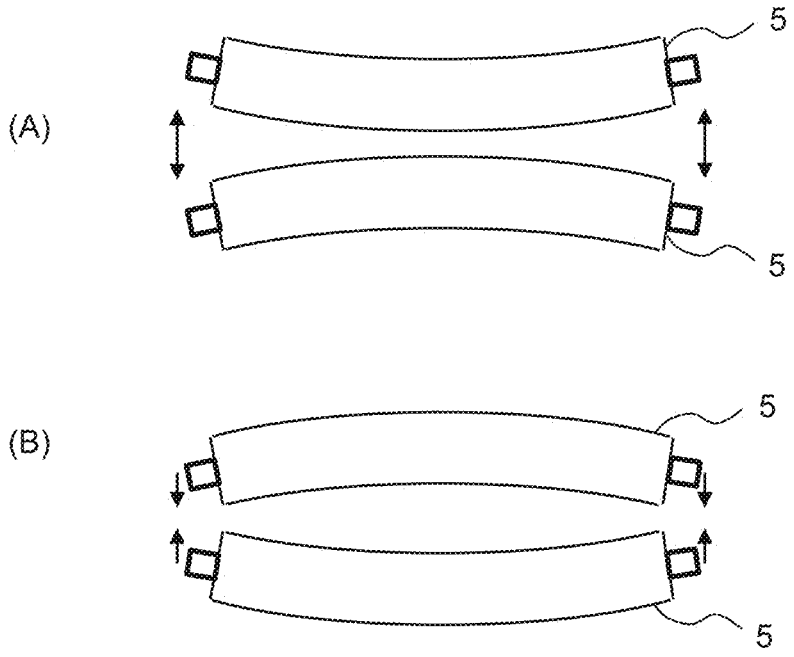
FIG. 3 is a diagram to explain the roll bender device of the rolling stand according to the embodiment.

FIG. 2 and FIG. 3 are diagrams to explain the roll bender device 7 of each of the rolling stands 2.

Each of the rolling stands 2 includes the roll bender device 7. Each i-th rolling stand (1≤i≤N) illustrated in FIG. 1 includes an i-th roll bender device (first roll bender device 71, second roll bender device 72, third roll bender device 73, fourth roll bender device 74, fifth roll bender device 75, sixth roll bender device 76, or seventh roll bender device 77) screwing down the material to be rolled 3 with preset roll bender pressure. In a case where the roll bender devices are not particularly distinguished from one another, the roll bender devices are simply referred to as the "roll bender devices 7".

The roll bender devices 7 are actuators bending the work rolls 5 so as to deflect center shafts of the work rolls 5. Each of the roll bender devices 7 includes a hydraulic cylinder applying the roll bender pressure (bending force) to both ends of rotary shafts of the corresponding upper and lower paired work rolls 5.

As illustrated in FIG. 3(A), increasing the roll bender pressure decreases the roll force at both ends of the work rolls and increases the roll force at center parts of the work rolls. This makes it possible to decrease a plate crown. The plate crown is a thickness difference between center and ends of a product in a plate width direction. Further, as illustrated in FIG. 3(B), decreasing the roll bender pressure increases the roll force at both ends of the work rolls and decreases the roll force at the center parts of the work rolls. This makes it possible to increase the plate crown.

2. Tail End Buckling Suppression Control

In a case where rolling is performed by the above-described finishing mill 1, "buckling accident" in which an extreme tail end of the material to be rolled meanders when passing through any of the rolling stands 2, to deteriorate passability, and the extreme tail end of the material to be rolled is folded by coming into contact with a side guide of the rolling stand 2 may occur. Therefore, the control device 8 according to the present embodiment includes a tail end buckling suppression unit 9 that can prevent the tail end buckling accident caused by meandering of the material to be rolled 3 by appropriately controlling the roll bender devices 7.

During a period after the tail end of the material to be rolled 3 comes out of one designated j-th (1≤j≤N−1) rolling stand until the tail end of the material to be rolled 3 comes out of the N-th rolling stand, the tail end buckling suppression unit 9 causes each of j+1-th to N-th roll bender devices 7 downstream of the j-th rolling stand to continuously lower the roll bender pressure. The roll bender pressure is continuously lowered from a set value by using a ramp function.

Further, each of the j+1-th to N-th roll bender devices holds, when the own roll bender pressure reaches balance pressure, the own roll bender pressure at the balance pressure. The balance pressure is reference pressure in a state where the back up rolls 6 and the work rolls 5 are brought into contact with each other while the material to be rolled 3 is absent.

(Designated Stand Information)

The j-th rolling stand that is the above-described designated stand is selected based on designated stand information. FIG. 4 is a table illustrating an example of the designated stand information according to the present embodiment. The designated stand information is information defining a plurality of relationships between a combination of a steel grade of the material to be rolled 3 with an N-th rolling stand delivery side target thickness, and the designated stand (j-th rolling stand) relating to tail end buckling suppression. The designated stand information is previously stored in a memory 82 (FIG. 6) of the control device 8.

The tail end buckling suppression control adapts to the thin material to be rolled 3 where the tail end buckling caused by meandering of the tail end easily occurs. The N-th rolling stand delivery side target thickness of the material to be rolled 3 where the tail end buckling caused by meandering easily occurs is, for example, 2.5 mm. In contrast, if the tail end buckling suppression control is performed on the thick material to be rolled 3, shape defect may occur. Therefore, depending on the combination of the steel grade with the N-th rolling stand delivery side target thickness, the designated stand relating to occurrence of the tail end buckling caused by meandering is not necessarily set.

The tail end buckling suppression unit 9 selects the designated stand (j-th rolling stand) from the designated stand information by receiving, as an input, the combination of the steel grade of the material to be rolled 3 with the N-th rolling stand delivery side target thickness. The steel grade and the N-th rolling stand delivery side target thickness relating to product specification can be acquired from an external apparatus before start of rolling.

3. Control Example

Figure 5:
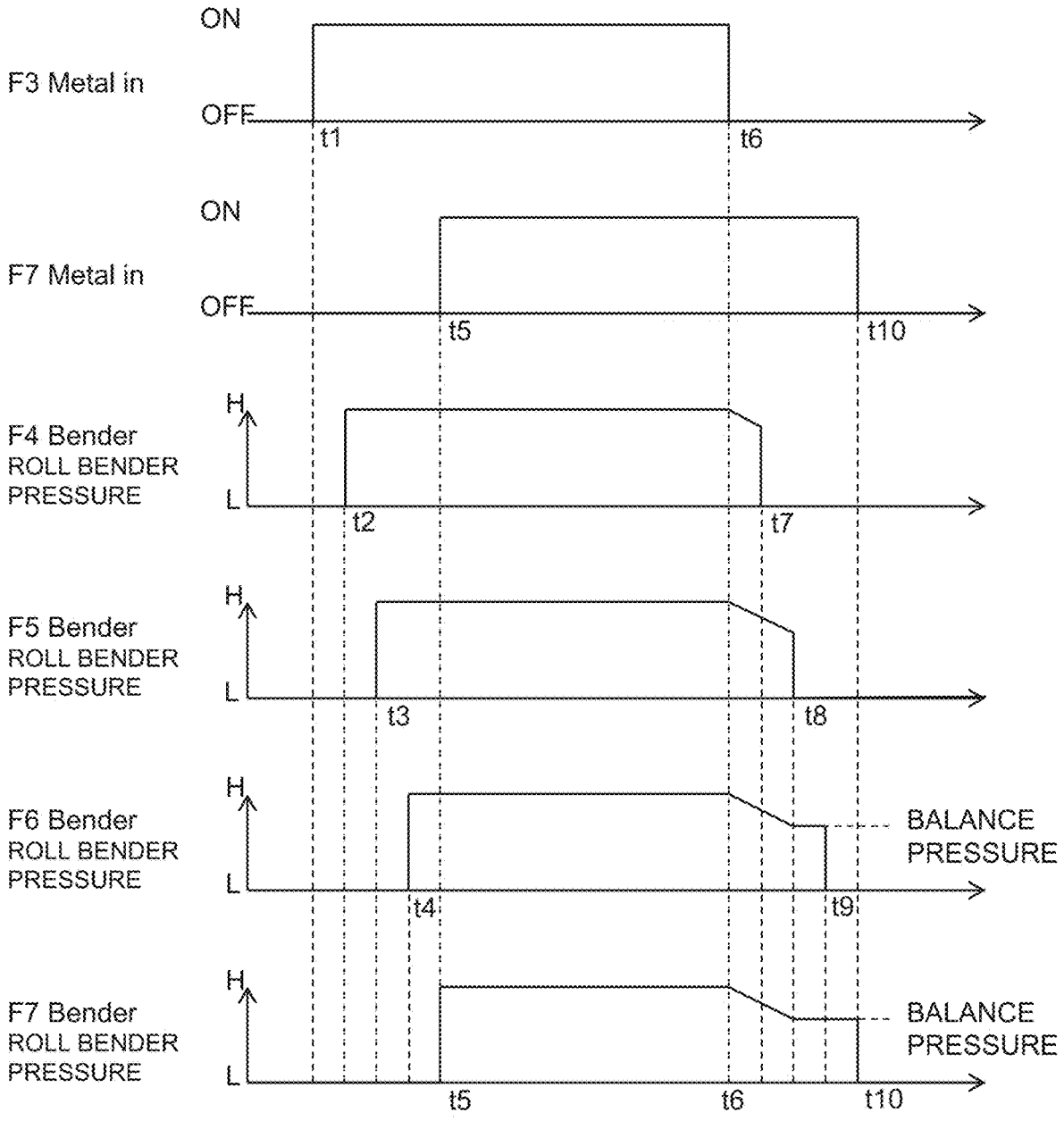
FIG. 5 is a timing chart to explain control timings of roll bender pressure according to the embodiment.

An example of the tail end buckling suppression control is described with reference to FIG. 5. FIG. 5 is a timing chart to explain control timings of the roll bender pressure.

A time t1 is a timing when a head end of the material to be rolled 3 reaches the third rolling stand 23. A time t2 is a timing when the head end of the material to be rolled 3 reaches the fourth rolling stand 24. A time t3 is a timing when the head end of the material to be rolled 3 reaches the fifth rolling stand 25. A time t4 is a timing when the head end of the material to be rolled 3 reaches the sixth rolling stand 26. A time t5 is a timing when the head end of the material to be rolled 3 reaches the seventh rolling stand 27 as a final stand.

A time t6 is a timing when the tail end of the material to be rolled 3 comes out of the third rolling stand 23. A time t7 is a timing when the tail end of the material to be rolled 3 comes out of the fourth rolling stand 24. A time t8 is a timing when the tail end of the material to be rolled 3 comes out of the fifth rolling stand 25. A time t9 is a timing when the tail end of the material to be rolled 3 comes out of the sixth rolling stand 26. A time t10 is a timing when the tail end of the material to be rolled 3 comes out of the seventh rolling stand 27 as the final stand.

In the example illustrated in FIG. 5, the third rolling stand 23 (j=3) is selected as the designated stand (j-th rolling stand). At the time t6, the tail end of the material to be rolled 3 passes through the third rolling stand 23 as the designated stand. Therefore, the tail end of the material to be rolled 3 loses constraint force by the work rolls 5 of the third rolling stand 23. From time t6 when the tail end of the material to be rolled 3 comes out of the third rolling stand 23, each of the roll bender devices 7 at the post-stage of the designated stand starts to lower the roll bender pressure.

The fourth roll bender device 74 continuously lowers the roll bender pressure from the set value at the time t6 during a period from the time t6 when the tail end of the material to be rolled 3 comes out of the third rolling stand 23 to the time t7 when the tail end of the material to be rolled 3 comes out of the fourth rolling stand 24.

The fifth roll bender device 75 continuously lowers the roll bender pressure from the set value at the time t6 during a period from the time t6 to the time t8 when the tail end of the material to be rolled 3 comes out of the fifth rolling stand 25.

The sixth roll bender device 76 continuously lowers the roll bender pressure from the set value at the time t6 during the period from the time t6 to the time t8. When the roll bender pressure reaches the balance pressure at the time t8, the sixth roll bender device 76 stops the control to lower the roll bender pressure. During a period from the time t8 to the time t9, the roll bender pressure is held at the balance pressure.

The seventh roll bender device 77 continuously lowers the roll bender pressure from the set value at the time t6 during the period from the time t6 to the time t8. When the roll bender pressure reaches the balance pressure at the time t8, the seventh roll bender device 77 stops the control to lower the roll bender pressure. During a period from the time t8 to the time t10, the roll bender pressure is held at the balance pressure.

4. Effects

As described above, the control device 8 according to the present embodiment lowers the roll bender pressure of the rolling stands 2 at the post-stage of the designated stand, thereby making the material to be rolled 3 into almost an end-elongated plate shape (state where ends in plate width direction are elongated more than center part). As a result, the material to be rolled 3 is controlled to pass through the center of the rolling line, and meandering of the material to be rolled 3 and tail end buckling are suppressed.

5. Hardware Configuration Example

Figure 6:
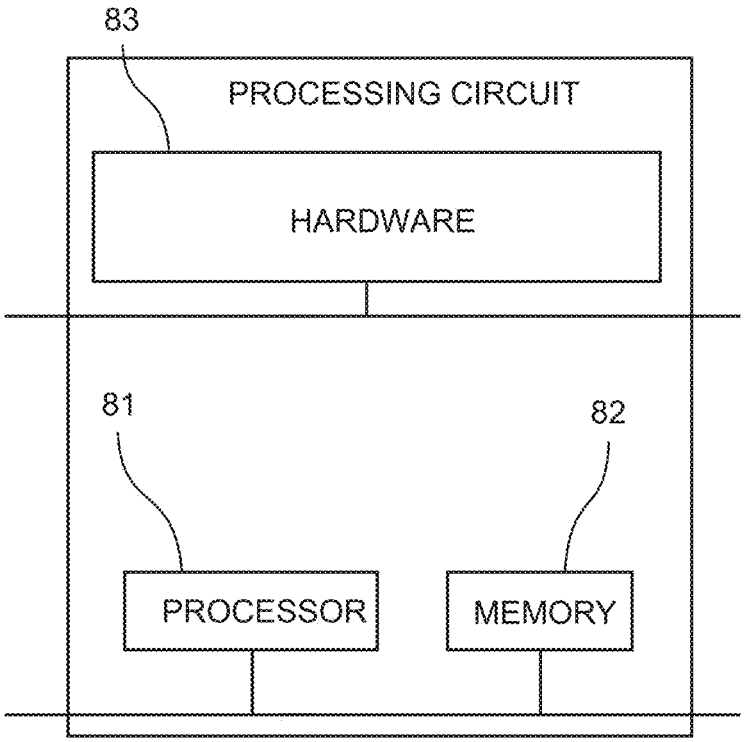
FIG. 6 is a block diagram illustrating a hardware configuration example of a control device according to the embodiment.

FIG. 6 is a conceptual diagram illustrating a hardware configuration example of a processing circuit that is held by the control device 8 functioning as the tail end buckling suppression device according to the embodiment. The units in the device indicate a part of functions, and the functions are realized by the processing circuit. As one mode, the processing circuit includes at least one processor 81 and at least one memory 82. As another mode, the processing circuit includes at least one piece of dedicated hardware 83.

In a case where the processing circuit includes the processor 81 and the memory 82, each of the functions is realized by software, firmware, or a combination of the software and the firmware. At least one of the software and the firmware is described as a program. At least one of the software and the firmware is stored in the memory 82. The processor 81 reads out and executes the program stored in the memory 82, to realize each of the functions.

In the case where the processing circuit includes the dedicated hardware 83, the processing circuit is, for example, a single circuit, a composite circuit, a programmed processor, or a combination thereof. Each of the functions is realized by the processing circuit.

Although the embodiment of the present invention is described above, the present invention is not limited to the above-described embodiment, and can be variously modified and implemented without departing from the spirit of the present invention. When numerals of the number, the quantity, the amount, the range, and the like of each of the elements are mentioned in the above-described embodiment, the present invention is not limited to the mentioned numerals except for the case of being particularly clearly mentioned and the case of being obviously specified to the numerals in principle. Further, the structure and the like described in the above-described embodiment are not necessarily essential for the present invention except for the case of being particularly clearly mentioned and the case of being obviously specified to the structure and the like in principle.

REFERENCE SIGNS LIST

1 Finishing mill
2 Rolling stand

3 Material to be rolled
5 Work roll
6 Back up roll
7 Roll bender device
8 Control device
9 Tail end buckling suppression unit
21 to 27 First to seventh rolling stands
71 to 77 First to seventh roll bender devices
81 Processor
82 Memory
83 Hardware

The invention claimed is:

1. A tail end buckling suppression device for a tandem rolling mill rolling a material to be rolled by N ($N \geq 3$) rolling stands arranged in series, wherein:

each i-th rolling stand ($1 \leq i \leq N$) of the tandem rolling mill includes an i-th roll bender device configured to screw down the material to be rolled with preset roll bender pressure; and a control device including a processor and a memory storing instructions that, when executed by the processor, cause the tail end buckling suppression device to perform causing each of the j+1-th to N-th roll bender devices to continuously lower the roll bender pressure as follows:

during a period beginning when a tail end of the material to be rolled comes out of one designated j-th rolling stand ($1 \leq j \leq N-1$) until the tail end of the material to be rolled comes out of the N-th rolling stand, the tail end buckling suppression device causes each of j+1-th to N-th roll bender devices downstream of the j-th rolling stand to continuously lower the roll bender pressure from the roll bender pressure preset for each of the j+1-th to N-th roll bender devices, wherein the continuous lowering of the roll bender pressure for each of the j+1-th to N-th roll bender devices is initiated when the tail end of the material to be rolled comes out of the j-th rolling stand.

2. The tail end buckling suppression device according to claim 1, wherein:

the tail end buckling suppression device stores designated stand information defining a plurality of relationships between a combination of a steel grade with an N-th rolling stand delivery-side target thickness, and a designated stand relating to tail end buckling suppression; and the j-th rolling stand is the designated stand selected from the designated stand information when the combination of the steel grade with the N-th rolling stand delivery-side target thickness is input.

3. The tail end buckling suppression device according to claim 1, wherein each of the j+1-th to N-th roll bender devices holds, when the roll bender pressure of that respective roll bender device reaches balance pressure, the roll bender pressure of that respective roll bender device at the balance pressure.

4. The tail end buckling suppression device according to claim 1, wherein the continuously lowering of the roll bender pressure is configured to increase a plate crown of the material to be rolled.

5. The tail end buckling suppression device according to claim 4, wherein the increase of the plate crown is configured to control the material to be rolled to pass through a center of a rolling line.

6. The tail end buckling suppression device according to claim 3, wherein the balance pressure is a reference pressure in a state where back up rolls and work rolls of the roll bender device are in contact with each other while the material to be rolled is absent.

7. The tail end buckling suppression device according to claim 1, wherein the period begins at a timing when the tail end of the material to be rolled loses constraint force from work rolls of the j-th rolling stand.

8. The tail end buckling suppression device according to claim 2, wherein the designated stand information is stored in the memory as a table.

9. The tail end buckling suppression device according to claim 1, wherein the tail end buckling suppression device uses a ramp function to continuously lower the roll bender pressure from the roll bender pressure preset for each of the j+1-th to N-th roll bender devices.

* * * * *